United States Patent [19]

Rakitsky et al.

[11] Patent Number: 4,810,259

[45] Date of Patent: Mar. 7, 1989

[54] METHOD TO MINIMIZE VISCOSITY AND IMPROVE STABILITY OF COAL-WATER FUELS

[75] Inventors: Walter G. Rakitsky, Tariffville; Martin A. Prieto, Enfield, both of Conn.

[73] Assignee: Oxce Fuel Company, Windsor, Conn.

[21] Appl. No.: 777,513

[22] Filed: Sep. 19, 1985

[51] Int. Cl.[4] ..... C10L 1/32

[52] U.S. Cl. ..... 44/51; 44/66; 44/72; 44/75; 44/76; 252/351

[58] Field of Search ..... 44/51, 66, 72, 75, 76; 252/351

[56] References Cited

U.S. PATENT DOCUMENTS

| | | | |
|---|---|---|---|
| 2,346,151 | 4/1944 | Burk et al. | 44/51 |
| 3,069,361 | 12/1962 | Cogswell | 44/51 |
| 4,125,382 | 11/1978 | O'Brien et al. | 44/51 |
| 4,242,098 | 12/1980 | Braun et al. | 44/51 |
| 4,295,859 | 10/1981 | Boehmke | 44/51 |
| 4,328,002 | 5/1982 | Bender | 44/1 SR |
| 4,358,293 | 11/1982 | Mark | 44/51 |
| 4,375,358 | 3/1983 | Swartz et al. | 44/51 |
| 4,424,062 | 1/1984 | Kamino et al. | 44/1 R |
| 4,441,889 | 4/1984 | Mark | 44/51 |
| 4,496,367 | 1/1985 | Mathiesen et al. | 44/51 |
| 4,547,200 | 10/1985 | Shinohara et al. | 44/51 |
| 4,560,390 | 12/1985 | Bender | 44/1 SR |

FOREIGN PATENT DOCUMENTS

| | | | |
|---|---|---|---|
| 0050412 | 9/1981 | European Pat. Off. | 44/51 |
| 2742466 | 3/1978 | Fed. Rep. of Germany | 44/1 SR |
| 56-036587 | 9/1981 | Japan | 44/51 |
| 59-152995 | 8/1984 | Japan | 44/51 |
| 59-204688 | 11/1984 | Japan | 44/51 |

*Primary Examiner*—William R. Dixon, Jr.
*Assistant Examiner*—Margaret B. Medley
*Attorney, Agent, or Firm*—Walter A. Hackler

[57] ABSTRACT

A coal aqueous slurry having a lower viscosity and resistance to thickening with time is provided. The coal aqueous slurry includes water, particulate coal comprising carbonaceous material and water-soluble minerals, a surfactant present in the coal aqueous slurry in an amount sufficient to disperse the particulate coal in the water and a chelating agent. The included chelating agent is capable of forming a chelation complex with the metal ions formed by the water-soluble minerals dissolving into the water. The presence of the chelating, or complexing, agent reduces coagulation of the coal particles, because the chelating agent complexes soluble mineral matter and thereby prevents collapse of the protective water layer surrounding the coal particles. The low viscosity of the coal aqueous slurry is maintained as a function of time by the chelating agent since, as the mineral matter present on the surface of the coal slowly dissolves into the aqueous medium, the chelating agent present in the slurry continues to form complexes therewith. This prevents the newly dissolved mineral matter from disturbing or collapsing the coal particles' protective water layer and therefore prevents a coagulation of the particulate coal during storage of the coal aqueous slurry.

57 Claims, No Drawings

METHOD TO MINIMIZE VISCOSITY AND IMPROVE STABILITY OF COAL-WATER FUELS

The present invention is related to coal-water fuels and, more particularly, is directed to a coal-water fuel not only having low viscosity, but also having improved resistance to thickening during extended periods of storage. Also encompassed by the present invention is a method of forming a coal-water fuel having low viscosity which is resistant to thickening and a method to minimize the viscosity and improve the stability of coal-water fuels.

It has been widely recognized that coal-water fuels, being a dispersion of coal and water having a sufficient amount of coal therein to be suitable for use as a combustion source, have inherent problems which include unwanted sedimentation, high viscosity and can exhibit the undesirable characteristic of increasing viscosity during storage. The instability with time is, of course, of significant importance if the coal-water fuel is to be transported or stored for extended periods and maintain favorable combustion characteristics.

These disadvantages have prevented extensive use of the world's abundant supply of coal in coal-water slurries useful as a fuel.

To be commercially acceptable on a large scale for combustion, coal-water fuels should be storable and easily transported to combustion sites. The feasibility of long-term storage, as well as the cost of such storage, and transportation of coal-water fuel is directly related to the resistance to flow of the coal-water fuel, as well as its ability to maintain a uniform composition with consistent rheological properties over a period of time.

Many additives have been utilized in coal-water fuels in an attempt to form stable dispersions of coal in water. While many of these have achieved some success in obtaining coal-water fuels with low viscosity and high shear stability upon mixing, these properties are often not always consistent with time.

It has been found that coal-water fuels may thicken during extended periods under shear, hence, during long periods of high shear pumping, thickening of the slurry causes significant problems.

In addition, coal-water fuels will thicken without the application of shear forces during storage with such thickening being a function of time. For example, many coal-water slurries thicken to a nonfluid state after only a few days of storage and are thereafter impossible to pump.

Well known is the fact that coals contain a variety of mineral matter and such mineral matter leaches into the water in which the coal is dispersed over extended periods of contact therebetween.

Effective dispersion or suspension of coal in water in coal-water fuels generally requires that the coal particles be completely surrounded and protected from contacting one another and researchers have tried many dispersing agents and surfactants to achieve such dispersions.

However, because of the enormous surface area presented by fine particles in the coal-water suspension, there is a large exposure of mineral matter present on the surface of the coal. When the mineral matter dissolves into the aqueous media, flocculation of the coal particles is promoted through collapsing of the protective water layer between the particles.

As an example, it is well known that alumina $Al^{+3}$ Ferric $Fe^{+3}$ and calcium $Ca^{+2}$ can coagulate coal in settling ponds.

The kinetics of the solution of the mineral matter is slow, hence, there is a continuing change in the concentration of metal ions over an extended period of time which can cause a continual aggregation of the coal.

SUMMARY OF THE INVENTION

In accordance with the present invention, a coal aqueous slurry having lower viscosity and resistance to thickening with time consists essentially of water, particulate coal comprising carbonaceous material and water-soluble minerals, a surfactant present in the coal-aqueous slurry in an amount sufficient to disperse the particulate coal in water, and a chelating agent capable of forming a chelation complex with metal ions formed by the water-soluble minerals dissolving into the water.

The presence of the chelating, or complexing, agent reduces coagulation of the coal particles because the chelating agent complexes soluble mineral matter, thereby preventing collapse of the protective water layer surrounding the coal particles.

More particularly, in accordance with the present invention, the chelating agent may comprise an aminocarboxylic acid, or a hydroxycarboxylic acid, which is capable of forming complexes with $Al^{+3}$, $Fe^{+3}$, $Mg^{+2}$ and $Ca^{+2}$ ions.

Preventing flocculation of the coal particles lowers the viscosity of the slurry. In addition, this low viscosity is maintained as a function of time since as the mineral matter present on the surface of the coal slowly dissolves into the aqueous media, the chelating agent present in the slurry continues to form complexes therewith, thereby preventing the newly dissolved mineral matter from disturbing or collapsing the coal particles' protective water layer and causing a coagulation of the particulate coal.

It has been found that a chelating agent may be selected from the group consisting of ethylenediaminetetraacetic acid, hydroxyethylethylenediaminetriacetic acid, nitrilotriacetic acid, N-dihydroxyethylglycine and ethylenebis(hydroxyphenylglycine).

In addition, it has been unexpectedly discovered that the use of a chelating agent, such as ethylenediaminetetraacetic acid, reduces the amount of surfactant that otherwise may have to be used if the chelating agent were not present.

If a polymeric stabilizer is incorporated into the coal-aqueous slurry, the presence of the complexing, or chelating, agent prevents cross-linking of the polymeric stabilizer and, thereby, maintains slurry fluidity through extended periods of storage.

It has been found that in accordance with the present invention that the addition of a chelating agent is effective in preventing the thickening of coal slurries over a period of time when the coal slurry includes a first surfactant having a hydrophilic portion comprising a relatively large number of ethyleneoxide units, and a second surfactant having a hydrophilic portion comprising of a relatively small number of ethyleneoxide units compared to the first surfactant. In this type of slurry, the first and second surfactants are present in the coal-aqueous slurry that disperse the particulate coal in the water.

The first surfactant may have a hydrophilic portion comprising between about 40 and 150 ethyleneoxide units and the second surfactant may have a hydrophilic portion comprising between about 4 and 40 ethyleneoxide units, with the first surfactant having a large number of ethyleneoxide units relative to the second surfactant.

Other chelating agents such as one selected from the group consisting of tartaric acid, citric acid, gluconic acid, and 5-sulfosalicyclic acid, may be used in the present invention.

A method in accordance with the present invention for forming a coal-water fuel includes the steps of admixing particulate coal including carbonaceous material and water-soluble minerals with ingredients consisting essentially of water, a surfactant for dispersing the particulate coal in the water, and a chelating agent capable of forming a chelation complex with the metal ions formed by the water-soluble minerals dissolving in the water.

Also included in the present invention is a method for improving stability of coal-water fuels against thickening with time. This method includes the step of admixing a coal-aqueous slurry comprising particulate coal including carbonaceous material and water-soluble minerals, water and a surfactant with a chelating agent capable of forming a chelation complex with metal ions formed by the water-soluble minerals dissolving in the water over a period of time.

DETAILED DESCRIPTION

The thickening of coal-water fuels over a period of time is caused, to a large extent, by the solvation of mineral matter present on the surface of the coal which causes flocculation of the coal particles and increases the viscosity of the coal-water fuel.

The present invention utilizes a chelating agent to form complexes with the metal ions formed.

Within the meaning of this invention, a chelating agent is a compound containing donor atoms that can combine by coordinate bonding with a metal atom to form a cyclic structure, called a chelation complex, or chelate.

Many chelating agents are known, and a number of them including aminocarboxylic and hydroxycarboxylic are shown in the hereinafter-recited examples to be effective in forming metal ion complexes in coal-water fuels to reduce viscosity and prevent thickening with time thereof in accordance with the present invention.

Preferably, the method in accordance with the present invention utilizes an ethylenediaminetetraacetic (EDTA) and/or citric acid.

Heretofore, simple salts such as sodium chloride and potassium chloride have been incorporated in various coal-water formulations in order to reduce slurry viscosity. However, they are ineffective in preventing continual increasing of the slurry viscosity because they are unable to form complexes with the dissolving mineral matter.

It is believed that this invention is the first discovery of the use of chelating agents in coal-water fuels in order to provide an instant reduction of viscosity and a continuing way of preventing solvated minerals in the coal particles from causing flocculation of the coal, which results in viscosity increases of the coal-water fuel over extended periods of time.

A number of surfactants may be utilized to disperse or suspend the coal particles in water, a particularly useful dispersant is polyalkyleneoxide nonionic surfactant such as commercially available glycol ethers of the general formula:

$$R—O—(CH_2CH_2O)_n—CH_2—CH_2—OH$$

wherein R is substituted or unsubstituted alkyl of from 1 to 18 carbon atoms, substituted or unsubstituted aryl, or an amino group and n is an integer from about 10 to about 100.

Of particular advantage is the utilization of a blend of nonylphenoxy polyethyleneoxide surfactants as described in U.S. Pat. Ser. No. 515,829, Filed July 21, 1983 and which is totally incorporated herein by specific reference thereto.

The preferred surfactant is a blend of nonylphenoxy polyethyleneoxide surfactants having about 100 ehtylene units and a nonylphenoxy polyethyleneoxide surfactant having about 10 ethyleneoxide units.

In the past, the type of coal which could be successfully formulated into coal-water fuels was limited in part because of the problems which result from the presence of mineral matter and the subsequent solvation thereof into the water.

In fact, many investigators have found it necessary to provide a complex coal preparation process by which much of the mineral matter is removed.

It has now been found that the addition of a small amount of chelating agent such as EDTA complexes soluble minerals such as aluminum, iron and calcium, do prevent thickening of the slurry with time.

Surprisingly, however, the addition of a small amount of chelating agent also significantly reduces the viscosity of the resulting coal-water fuel and can significantly reduce the amount of surfactant necessary to disperse, or suspend the coal in the water.

It has also been found that the presence of a complexing agent can prevent cross-linking of polymeric stabilizers added to the coal-water fuel to further maintain slurry fluidity during extend periods of storage.

A wide variety of suitable coals may be used in the present invention, such as anthracite, high and low volatile bituminous, sub-bituminous, mine tailings and fines.

The following are specific examples and preferred embodiments of the present invention. There is no intention that the claims be limited thereto, since many variations are within the skill of the art.

For instance, while the chelating agent may be used in conjunction with one or more surfactants in a coal fuel, two surfactants were used in many of the following examples for illustrative purposes only.

EXAMPLE 1

Water was mixed with two surfactants, namely, a nonylphenoxy polyethyleneoxide having about 100 ethylene units (molecular weight about 4680) (IGEPAL CO990, GAF Corporation, New York) and a nonylphenoxy polyethyleneoxide surfactant having about 10 ethyleneoxide units (molecular weight about 682) (IGEPAL CO660, GAF Corporation, New York) along with an anti-foam agent such as Foamaster and Ucarcide until all the material is well dispersed. Coal ground to approximately 80% less than 200 mesh was then added to the solution and the mixture was agitated at 1900 RPM for 15 minutes.

To this slurry, a polymeric stabilizer such as xanthan gum was added and the mixture was agitated for another 15 minutes at 1900 RPM. The stabilizer may comprise from about 0.01 to about 0.1 percent by weight of the coal-water fuel, although 0.075 percent by weight is specifically recited in this example. Weight percentages of the resulting coal-water fuel are shown in Table 1.

TABLE 1

| Component | Weight | Wt. % |
|---|---|---|
| Coal | 350 g | 70.0 |
| CO990 (surfactant) | 2.0 | 0.4 |
| CO660 (surfactant) | 0.5 | 0.1 |
| Foamaster (antifoam) | 0.5 | 0.1 |
| Ucarcide (preservative) | 1.0 | 0.2 |
| Xanthan Gum (12½%) (stabilizer) | 2.88 | 0.075 |
| Water | 143.12 | 29.1 |

Viscosities were measured using a Haake RV-2 Rotational Viscometer, using an M500 measuring head and an MV-III rotor at a shear rate of 110 $sec^{-1}$.

Slurries were then prepared as hereinabove-described except that a viscosity modifier was incorporated into the slurry. Table 2 shows the weight percentage of viscosity modifier added and the resulting viscosity of the coal-water slurry. Without the addition of a viscosity modifier, the slurry exhibited a viscosity of about 1124 cp (row one).

With the addition of 0.15 wt.% EDTA or 0.20 wt.% citric acid as chelating agents, the viscosity of the slurry was reduced to 806 cp and 901 cp respectively. This significant reduction in viscosity did not occur when non-chelating modifiers such as NaCl or $CaCl_2$ were incorporated into the slurry, in fact, the viscosity of the slurry increased as a result of incorporating NaCl or $CaCl_2$.

TABLE 2

| Coal wt. % (10% Ash) | Viscosity Modifier wt. % | Viscosity cp (110 Sec) | Solids Content wt. % |
|---|---|---|---|
| 70 | — | 1124 | 70.75 |
| 70 | .15 EDTA | 806 | 70.90 |
| 70 | .15 NaCl | 1134 | 70.90 |
| 70 | .15 $CaCl_2$ | 1246 | 70.90 |
| 70 | .20 Citric Acid | 901 | 71.33 |

The viscosity is, of course, dependent on the solids content, with the viscosity being higher as the solids content increases. Bearing this in mind, it can be easily seen from Table 2 that the addition of 0.15 weight percent EDTA still reduces the viscosity of the coal-water fuel (without the addition of EDTA) from 1124 cp to 806 cp. That is, a reduction of about 28%, while the solids content is actually increased from 70.75 wt.% to 70.90 wt.%.

The addition of 0.20 weight percent citric acid also significantly reduces the viscosity of the resulting coal-water fuel to 901 cp while the solids content increased from 70.75 wt.% to 71.93 wt.% due to water loss during slurry preparation.

The weight percent of the surfactants utilized in the herein presented Example may vary in accordance with the ranges taught in U.S. patent application Ser. No. 515,829, Filed July 21, 1983, namely, the CO990 may be present in an amount from about 0.1 percent to about 3.0 percent by weight of the coal-water fuel and the CO660 may be present in an amount from about 0.01 to about 1.5 percent by weight of the coal-water fuel.

EXAMPLE 2

To determine the effectiveness of EDTA in decreasing the viscosity of coal-water fuels as a function of the amount of EDTA added, various slurries were made as hereinbefore set forth in Example 1 except varying the EDTA content from about 0.05 weight percent to about 0.20 weight percent. The results of viscosity measurements on these slurries are shown in Table 3.

TABLE 3

| Coal wt. % (10% Ash) | EDTA wt. % | Viscosity cp (110 Sec) | Solids Content wt. % |
|---|---|---|---|
| 70 | — | 1186 | 71.16 |
| 70 | .05 | 1021 | 71.17 |
| 70 | .10 | 983 | 71.19 |
| 70 | .15 | 896 | 71.20 |
| 70 | .20 | 911 | 71.22 |

It is apparent from FIG. 2 that as little as 0.05 weight percent EDTA significantly reduces the viscosity of the resulting coal-water fuel.

EXAMPLE 3

The presence of complexing agent also significantly reduces the amount of surfactant necessary to suspend or to disperse the coal in the water. Slurries were prepared as hereinbefore set forth in Example 1 with a reduced total amount of surfactant as shown in Table 4.

TABLE 4

| Coal wt. % (6% Ash) | Surfactant wt. % | EDTA wt. % | Stabilizer wt. % | Viscosity cp (110 $sec^{-1}$) |
|---|---|---|---|---|
| 70 | .55* | — | .075 | 1802 |
| 70 | .40** | .10 | .075 | 1599 |

*CO990 - 0.40%; CO660 - 0.15%
**CO990 - 0.30%; CO660 - 0.10%

As can be seen in Table 4, the use of 0.01 percent EDTA reduces the total amount of surfactant necessary to suspend 70% coal in water from about 0.55 weight percent to about 0.40 weight percent.

The following example demonstrates the important feature of the present invention in improving stability of coal-water fuels against its viscosity increasing with time.

EXAMPLE 4

Water was mixed with a nonylphenoxy polyethyleneoxide having about 100 ethylene units (molecular weight about 4680) (IGEPAL CO990, GAF Corporation, New York) along with an anti-foam agent such as Foamaster and Ucarcide until all the material is well dispersed. Coal ground to approximately 80% less than 200 mesh was then added to the solution and the mixture was agitated at 1900 RPM for 15 minutes.

To this slurry, a polymeric stabilizer such as xanthan gum (Flocon 4800C) was added and the mixture was agitated for another 15 minutes at 1900 RPM. The stabilizer may comprise from about 0.01 to about 0.1 percent by weight of the coal-water fuel, although 0.075 percent by weight is specifically recited in this Example. Weight percentages of the resulting coal-water fuel (Slurry A) are shown in Table 5.

TABLE 5

(Slurry A)

| Component | Wt. % |
|---|---|
| Coal (10% Ash) | 69.0 |
| CO990 (surfactant) | 0.8 |
| Foamaster (anti-foam) | 0.1 |
| Ucarcide (preservative) | 0.1 |
| Xanthan Gum (12½%) (stabilizer) | 0.075 |
| Water | 29.9 |

A second coal-water fuel (Slurry B) was then made in accordance with the method hereinabove-described for Slurry A except a chelating agent was incorporated into the coal water fuel to form Slurry B, weight percentages being shown in Table 6.

TABLE 6

(Slurry B)

| Component | Wt. % |
|---|---|
| Coal (10% Ash) | 68 |
| CO990 (surfactant) | 0.8 |
| Foamaster (anti-foam) | 0.1 |
| Ucarcide (preservative) | 0.1 |
| Xanthan Gum (12½%) (stabilizer) | 0.075 |
| EDTA (chelating agent) | 0.19 |
| Water | 30.7 |

Slurry A and B were allowed to stand and were observed over a period sufficient to determine the time necessary for Slurry A to thicken from a fluid state to a non-fluid state. As shown in Table 7, Slurry A (without a chelating agent) thickened from a fluid to a non-fluid in seven days while Slurry B (with EDTA chelating agent) did not exhibit any thickening.

TABLE 7

| Slurry | Chelating Agent | Appearance 1 Day | 2 Days | 7 Days |
|---|---|---|---|---|
| A | No | Fluid | Thick Fluid | Non-Fluid |
| B | Yes | Fluid | Fluid | Fluid |

EXAMPLE 5

Coal-water fuels may be made in accordance with Examples 1–4 herein except that instead of EDTA or citric acid as a chelating agent, tartaric acid, gluconic acid or 5-sulfosalicylic acid may be used as chelating agents with similar results as shown in Examples 1–4.

Although there has been hereinabove-described a specific coal-water fuel, its method of manufacture and method for improving the stability of coal-water fuels against thickening with time and reducing the viscosity of the resulting slurry, all in accordance with the invention for the purposes of illustrating the manner in which the invention may be used to advantage, it would be appreciated that the invention is not limited thereto. Accordingly, any and all modifications, variations or equivalent arrangements which may occur to those skilled in the art should be considered to be within the scope of the invention as defined in the appended claims.

What is claimed is:

1. A coal-water fuel consisting essentially of:

water, said water being present in an amount from about 49.3 percent to about 19.3 percent by weight of the coal-water fuel;

particulate coal comprising carbonaceous material and water-soluble minerals, said particulate coal being present in an amount from about 50 percent to about 80 percent by weight of the coal-water fuel;

a surfactant present in the coal-water fuel in an amount sufficient to disperse the particulate coal in the water; and a chelating agent capable of forming a chelation complex with metal ions formed by said water-soluble minerals dissolving in said water.

2. The coal-water fuel as defined in claim 1 wherein the particulate coal is present in an amount from about 50 percent to about 80 percent by weight of the coal-water fuel and the water is present in an amount from about 49.3 percent to about 19.3 percent by weight of the coal-water fuel.

3. The coal-water fuel of claim 1 wherein the water-soluble minerals present in the particulate coal comprise minerals forming $Al^{+3}$, $Fe^{+3}$ and $Ca^{+2}$ ions when dissolved in water.

4. The coal-water fuel of claim 2 wherein the chelating agent comprises an aminocarboxylic acid.

5. The coal-water fuel of claim 2 wherein the chelating agent is selected from the group consisting of ethylenediamenetetraacetic acid, hydroxyethylethylenediaminetriacetic acid, nitrilotriacetic acid, N-dihydroxyethylglycine and ethylenebis (hydroxyphenylglycine).

6. The coal-water fuel of claim 2 wherein the chelating agent consists of ethylenediaminetetraacetic acid.

7. The coal-water fuel of claim 2 wherein the chelating agent comprises a hydroxycarboxylic acid.

8. The coal-water fuel of claim 2 wherein the chelating agent is selected from the group consisting of tartaric acid, citric acid, gluconic acid and 5-sulfosalicyclic acid.

9. The coal-water fuel of claim 2 wherein the chelating agent comprises citric acid.

10. The coal-water fuel of claim 4 wherein the chelating agent is present in an amount sufficient to reduce the viscosity of the coal-aqueous slurry.

11. The coal-water fuel of claim 10 wherein the chelating agent is present in the amount of about 0.01 percent to about 0.20 percent by weight of the coal-water fuel.

12. The coal-water fuel of claim 4 wherein the chelating agent is present in an amount sufficient to prevent thickening of the coal-water fuel with time.

13. The coal-water fuel of claim 12 wherein the chelating agent is present in the amount of about 0.01 percent to about 0.20 percent by weight of the coal-water fuel.

14. A coal-water fuel consisting essentially of:

water;

particulate coal comprising carbonaceous material and water-soluble minerals;

a first surfactant having a hydrophilic portion comprising a relatively large number of ethylene oxide units;

a second surfactant having a hydrophilic portion comprising a relatively small number of ethylene oxide units compared to said first surfactant, said first and second surfactants being present in the coal-water fuel to disperse the particulate coal in the water; and a chelating agent capable of forming a chelation complex with metal ions formed by said water-soluble minerals dissolving in said water.

15. A coal-water fuel consisting essentially of:

water;

particulate coal comprising carbonaceous material and water-soluble minerals;

a first surfactant having a hydrophilic portion comprising between about 40 and 150 ethylene oxide units;

a second surfactant having a hydrophilic portion comprising between about 4 and 40 ethylene oxide units, said first and second surfactants being present in the coal-aqueous slurry in amounts sufficient to disperse the particulate coal in the water, said first surfactant having a large number of ethylene oxide units relative to said second surfactant; and a chelating agent capable of forming a chelation complex with metal ions formed by said water-soluble minerals dissolving in said water.

16. The coal-water fuel of claim 15 wherein the water-soluble minerals present in the particulate coal comprise minerals forming $Al^{+3}$, $Fe^{+3}$, $Mg^{+2}$, and $Ca^{+2}$ ions when dissolved in water.

17. The coal-water fuel of claim 15 wherein the chelating agent comprises an aminocarboxylic acid.

18. The coal-water fuel of claim 15 wherein the chelating agent is selected from the group consisting of ethylenediaminetetraacetic acid, hydroxyethylethylenediaminetriacetic acid, nitrilotriacetic acid, N-dihydroxyethylglycine and ethylenebis (hydroxyphenylglycine).

19. The coal-water fuel of claim 15 wherein the chelating agent consists of ethylenediaminetetraacetic acid.

20. The coal-water fuel of claim 15 wherein the chelating agent comprises a hydroxycarboxylic acid.

21. The coal-water fuel of claim 15 wherein the chelating agent is selected from the group consisting of tartaric acid, citric acid, gluconic acid and 5-sulfosalicylic acid.

22. The coal-water fuel of claim 15 wherein the chelating agent comprises citric acid.

23. The coal-water fuel as defined in claim 15 wherein the first surfactant is present in an amount from about 0.1 percent to about 3.0 percent by weight of the coal-water fuel, the second surfactant is present in an amount from about 0.01 percent to about 1.5 percent by weight of the coal-water fuel and the chelating agent is present in an amount from about 0.05 percent by weight of the coal-water fuel to about 0.20 percent by weight of the coal-water fuel.

24. The coal-water fuel as defined in claim 23 wherein the first and the second surfactants comprise polyalkylenoxide nonionic surfactants.

25. The coal-water fuel as defined in claim 24 wherein the first surfactant hydrophilic portion comprises about 100 units of ethylene oxide and the second surfactant hydrophilic portion comprises about 10 units of ethylene oxide.

26. The coal-water fuel as defined in claim 25 wherein the first surfactant has a molecular weight of about 4680, and the second surfactant has a molecular weight of about 682.

27. The coal-water fuel as defined in claim 26 further containing an anionic stabilizer.

28. The coal-water fuel as defined in claim 27 wherein the stabilizer comprises about 0.01 to 0.2 percent by weight of the coal-water fuel.

29. The coal-water fuel of claim 15 wherein the chelating agent is present in an amount sufficient to reduce the viscosity of the coal-water fuel.

30. The coal-water fuel of claim 29 wherein the chelating agent is present in the amount of about 0.01 percent to about 0.20 percent by weight of the coal-water fuel.

31. The coal-water fuel of claim 15 wherein the chelating agent is present in an amount sufficient to prevent thickening of the coal-water fuel with time.

32. The coal-water fuel of claim 31 wherein the chelating agent is present in the amount of about 0.05 percent to about 0.20 percent by weight of the coal-water fuel.

33. A coal-water fuel consisting essentially of:

particulate coal comprising carbonaceous material and water-soluble minerals, said particulate coal comprising about 70 percent by weight of the total coal-water fuel;

a first nonylphenoxy polyoxyethyleneoxide surfactant having a hydrophobic portion and a hydrophilic portion comprising about 100 ethylene units, said first nonylphenoxy polyoxyethylene surfactant comprising about 0.4 percent by weight of the coal-water fuel;

water comprising about 30 percent by weight of the coal-water fuel;

a second nonylphenoxy polyoxyethylene surfactant having a hydrophobic portion and a hydrophilic portion comprising about 10 ethylene oxide units, said second nonylphenoxy polyoxyethylene surfactant comprising about 0.1 percent by weight of the coal-water fuel; and, a chelating agent capable of forming a chelation complex with metal ions formed by said water-soluble minerals dissolving in said water, said chelating agent comprising about 0.15 percent by weight of the coal-water fuel.

34. The coal-water fuel as defined in claim 33 further consisting of xanthan gum as a stabilizer, said stabilizer comprising about 0.075 percent by weight of the coal-water fuel.

35. A coal-water fuel consisting essentially of:

water;

particulate coal comprising carbonaceous material and water-soluble minerals;

a plurality of surfactants, each having a hydrophilic portion, each surfactant hydrophilic portion having a different molecular weight and said plurality of surfactants being present in amounts sufficient to disperse the particular coal in the water; and, a chelating agent capable of forming a chelation complex with metal ions formed by said water-soluble minerals dissolving in said water.

36. The coal-water fuel as defined in claim 35 wherein the hydrophilic portion of each surfactant comprises polymerized ethylene oxide.

37. The coal-water fuel as defined in claim 36 wherein each surfactant comprises polyalkylenoxide nonionic surfactants.

38. A method for forming a coal-water fuel comprising the steps of: admixing particulate coal including carbonaceous material and water-soluble minerals with ingredients consisting essentially of water, a surfactant for dispersing the particulate coal in the water and a chelating agent capable of forming a chelation complex with metal ions formed by said water-soluble minerals dissolving in said water, said particulate coal being present in an amount from about 50 percent to about 80 percent by weight of the coal-water fuel, said water being present in an amount from about 49.3 percent to about 19.3 percent by weight of the coal-water fuel.

39. The method for forming a coal-water fuel according to claim 38 wherein the water-soluble minerals present in the particulate coal comprise minerals forming $Al^{+3}$, $Fe^{+3}$, $Mg^{+2}$, and $Ca^{+2}$ ions when dissolved in water.

40. The method for forming a coal-water fuel according to claim 39 wherein the chelating agent comprises an aminocarboxylic acid.

41. The method for forming coal-water fuel according to claim 40 wherein the chelating agent is selected from the group consisting of ethylenediaminetetraacetic acid, hydroxyethylethylenediaminetriacetic acid, nitrilotriacetic acid, N-dihydroxyethylglycine and ethylenebis (hydroxyphenylglycine).

42. The method for forming coal-water fuel according to claim 41 wherein the chelating agent consists of ethylenediaminetetraacetic acid.

43. The method for forming coal-water fuel according to claim 39 wherein the chelating agent comprises a hydroxycarboxylic acid.

44. The method for forming coal-water fuel according to claim 43 wherein the chelating agent is selected from the group consisting of tartaric acid, citric acid, gluconic acid and 5-sulfosalicylic acid.

45. The method for forming coal-water fuel according to claim 44 wherein the chelating agent comprises citric acid.

46. A method for forming a coal-water fuel comprising the steps of: admixing particulate coal including carbonaceous material and water-soluble minerals with ingredients consisting essentially of water, a first surfactant having a hydrophilic portion comprising between about 40 and 150 ethylene oxide units, and a second surfactant having a hydrophilic portion comprising between about 4 and 40 ethylene oxide units, said first surfactant having a large number of ethylene oxide units relative to said second surfactant; and a chelating agent capable of forming a chelation complex with metal ions formed by said water-soluble minerals dissolving in said water.

47. The method of forming a coal-water fuel according to claim 46 wherein the particulate coal is added in an amount to cause the coal-aqueous slurry to comprise from about 50 percent to about 80 percent by weight particulate coal and the water is added in an amount to cause the coal-aqueous slurry to comprise from about 49.3 percent to about 19.3 percent by weight water.

48. The method of forming a coal-water fuel according to claim 47 wherein the first surfactant is added in an amount to cause the coal-aqueous slurry to comprise from about 0.1 percent to about 3.0 percent by weight, first surfactant, the second surfactant is added in an amount to cause the coal-aqueous slurry to comprise from about 0.01 percent to about 1.5 percent by weight second surfactant and the chelating agent is added in an amount to cause the coal-aqueous slurry to comprise from about 0.01 percent to about 0.20 percent by weight chelating agent.

49. The method of forming a coal-water fuel according to claim 48 wherein the first and second surfactants are polyalkylenoxide nonionic surfactants.

50. A method for improving stability of coal-water fuels against thickening with time comprising the steps of admixing a coal-aqueous slurry comprising particulate coal including carbonaceous material and water-soluble minerals, water and a surfactant with a chelating agent capable of forming a chelation complex with metal ions formed by said water-soluble minerals dissolving in said water over a period of time.

51. The method for improving stability of coal-water fuels against thickening with time according to claim 50 wherein the water soluble minerals present in the particulate coal comprise minerals forming $Al^{+3}$, $Fe^{+3}$, $Mg^{+2}$, and $Ca^{+2}$ ions when dissolved in water.

52. The method for improving stability of coal-water fuels against thickening with time according to claim 51 wherein the chelating agent comprises an aminocarboxylic acid.

53. The method for improving stability of coal-water fuels against thickening with time according to claim 51 wherein the chelating agent is selected from the group consisting of ethylenediaminetetraacetic acid, hydroxyethylethylenediaminetriacetic acid, nitrilotriacetic acid, N-dihydroxyethylglycine and ethylenebis (hydroxyphenylglycine).

54. The method for improving stability of coal-water fuels against thickening with time according to claim 51 wherein the chelating agent consists of ethylenediaminetetraacetic acid.

55. The method for improving stability of coal-water fuels against thickening with time according to claim 51 wherein the chelating agent comprises a hydroxycarboxylic acid.

56. The method for improving stability of coal-water fuels against thickening with time according to claim 55 wherein the chelating agent is selected from the group consisting of tartaric acid, citric acid, gluconic acid and 5-sulfosalicylic acid.

57. The method for improving stability of coal-water fuels against thickening with time according to claim 56 wherein the chelating agent comprises citric acid.

* * * * *